US007316082B2

(12) United States Patent
Hernandez Martinez-Portillo et al.

(10) Patent No.: US 7,316,082 B2
(45) Date of Patent: Jan. 8, 2008

(54) METATARSAL PROTECTION FOR SAFETY FOOTWEAR

(75) Inventors: Luis Miguel Hernandez Martinez-Portillo, La Rioja (ES); Adelardo Arechavaleta Garcia, La Rioja (ES)

(73) Assignee: Calzados Robusta, S.L. (ES)

( * ) Notice: Subject to any disclaimer, the term of this patent is extended or adjusted under 35 U.S.C. 154(b) by 387 days.

(21) Appl. No.: 10/953,404

(22) Filed: Sep. 28, 2004

(65) Prior Publication Data

US 2005/0178027 A1 Aug. 18, 2005

(30) Foreign Application Priority Data

Feb. 13, 2004 (ES) ..... 200400343

(51) Int. Cl.
*A43B 23/26* (2006.01)
*A43B 13/22* (2006.01)

(52) U.S. Cl. ..... 36/72 R; 36/54

(58) Field of Classification Search ..... 36/72 R, 36/54

See application file for complete search history.

(56) References Cited

U.S. PATENT DOCUMENTS

| | | | | |
|---|---|---|---|---|
| 3,841,004 | A * | 10/1974 | Gray et al. | 36/72 R |
| 3,995,382 | A * | 12/1976 | Smith | 36/72 R |
| 4,231,170 | A * | 11/1980 | Griswold | 36/72 R |
| 5,711,092 | A * | 1/1998 | Despres et al. | 36/72 R |
| 6,170,174 | B1 * | 1/2001 | Gesso | 36/72 R |
| 6,389,715 | B1 * | 5/2002 | Krajcir | 36/77 R |
| 2005/0178027 | A1 * | 8/2005 | Hernandez Martinez-Portillo et al. | 36/72 R |

* cited by examiner

*Primary Examiner*—Ted Kavanaugh
(74) *Attorney, Agent, or Firm*—Michael Best & Friedrich LLP

(57) ABSTRACT

It is constituted on the basis of a tongue (1) which is conveniently attached to the boot, which is divided into a number of sectors (3), in which are some receptacles (5) which hold sheets (6) of material resistant to impact and ductile in order to facilitate the adaptation thereof to the form of the boot when closed. The sectors (3) are delimited by some lines of stitching (4) which facilitate the relative inclination between sectors (3) and therefore the articulation of the tongue (1) when the boot is flexed achieving greater user comfort.

3 Claims, 2 Drawing Sheets

METATARSAL PROTECTION FOR SAFETY FOOTWEAR

This application claims the benefit of priority of Spanish Patent Application No. 200400343, filed Feb. 13, 2004.

OBJECT OF THE INVENTION

The present invention is of application for safety footwear employed in industry, of the type of that which incorporates protection to protect the user's feet fundamentally from impacts, as well as additionally from heat and the action of aggressive liquids.

The object of the invention is a metatarsal protection for safety footwear which is highly resistant to impact, whilst having the capability to adapt its form to the elastic deformation which is produced in the boot when walking or when the foot is flexed in a stationary position, achieving in this way greater comfort in the use of this type of footwear.

BACKGROUND OF THE INVENTION

Safety boots conventionally incorporate a toecap with metallic reinforcement to avoid injuries which could arise from the impact of an object which fell accidentally on the worker's boot. As a supplement to this reinforcing element it is envisaged, not only to protect the toecap area of the foot, but also to confer an added value to the boot through the incorporation of protection in the area of the instep.

This protection, usually termed metatarsal, is formed by means of a stiff tongue which reduces movement and articulation capacity, especially in the metatarsal area.

The protection normally hinges with respect to an emerging flap defined in the toecap of the boot to which it is joined by stitching or by means of rivets and is formed in a single material, which can be plastic or metallic, and also have curved forms which adapt to the shape of the metatarsal sector of the safety boot and in some developments it is envisaged that it be of reduced length without managing to cover the height of the boot with the object of guaranteeing a minimum articulation of the foot.

This solution however is not completely satisfactory since, by not covering the whole extension of the metatarsal sector there remains an extensive area of the foot, ankle and area where the leg joins the ankle exposed to impacts, and also the discomfort and cutting effect that the stiff tongue has on the user.

The development of protection for safety footwear in which a compromise is reached between resistance to impact and flexibility, whilst guaranteeing the protection of the whole metatarsal area makes the invention feasible which is disclosed below.

DESCRIPTION OF THE INVENTION

The metatarsal protection which constitutes the object of this invention fully covers the expressed expectations in the measure that it offers effective protection for the whole metatarsal area whilst providing flexibility for its adaptation to the movement of the boot resulting therefore in substantial comfort for the user.

The metatarsal protection fundamentally comprises a tongue formed by individual layers of leather or of appropriate material, which is divided into sectors in which receptacles are defined which hold sheets of impact-resistant material and at the same time offer a certain ductility to allow a certain deformation of the tongue and thereby good adaptation to the morphology of the boot, when worn on the foot and closed. These sectors are delimited by lines of stitching sewn transversally which facilitate the articulation of the tongue when the boot is flexed eliminating in this way the stiffness which usually accompanies other systems of protection.

The sheet of impact-resistant and ductile material (for example aluminium) can be clad with a padded material, like latex foam for example, which constitutes a covering which prevents the cutting effect of the sheet, whilst increasing comfort.

The tongue is secured by stitching to the toecap of the boot and could even be reinforced by means of rivets.

The protection so constituted guarantees the absorption of impacts by means of the sheets of resistant material which are located in different sectors of the tongue, preferably parallel and separated by a short distance. This separating gap facilitates articulation between said sectors, allowing the tongue to adapt to the form of the instep of the boot when flexed.

The incorporation of this protection does not constitute any impediment whatsoever for the adoption of any boot closing system, be it by means of a hook and loop type fastener, e.g., a VELCRO strip, laces or any other solution.

DESCRIPTION OF THE DRAWINGS

To complete the description that is being made and with the object of assisting in a better understanding of the characteristics of the invention, in accordance with a preferred example of practical embodiment thereof, accompanying said description as an integral part thereof, is a set of drawings wherein, by way of illustration and not restrictively, the following has been represented.

PREFERRED EMBODIMENT OF THE INVENTION

Figure 1:
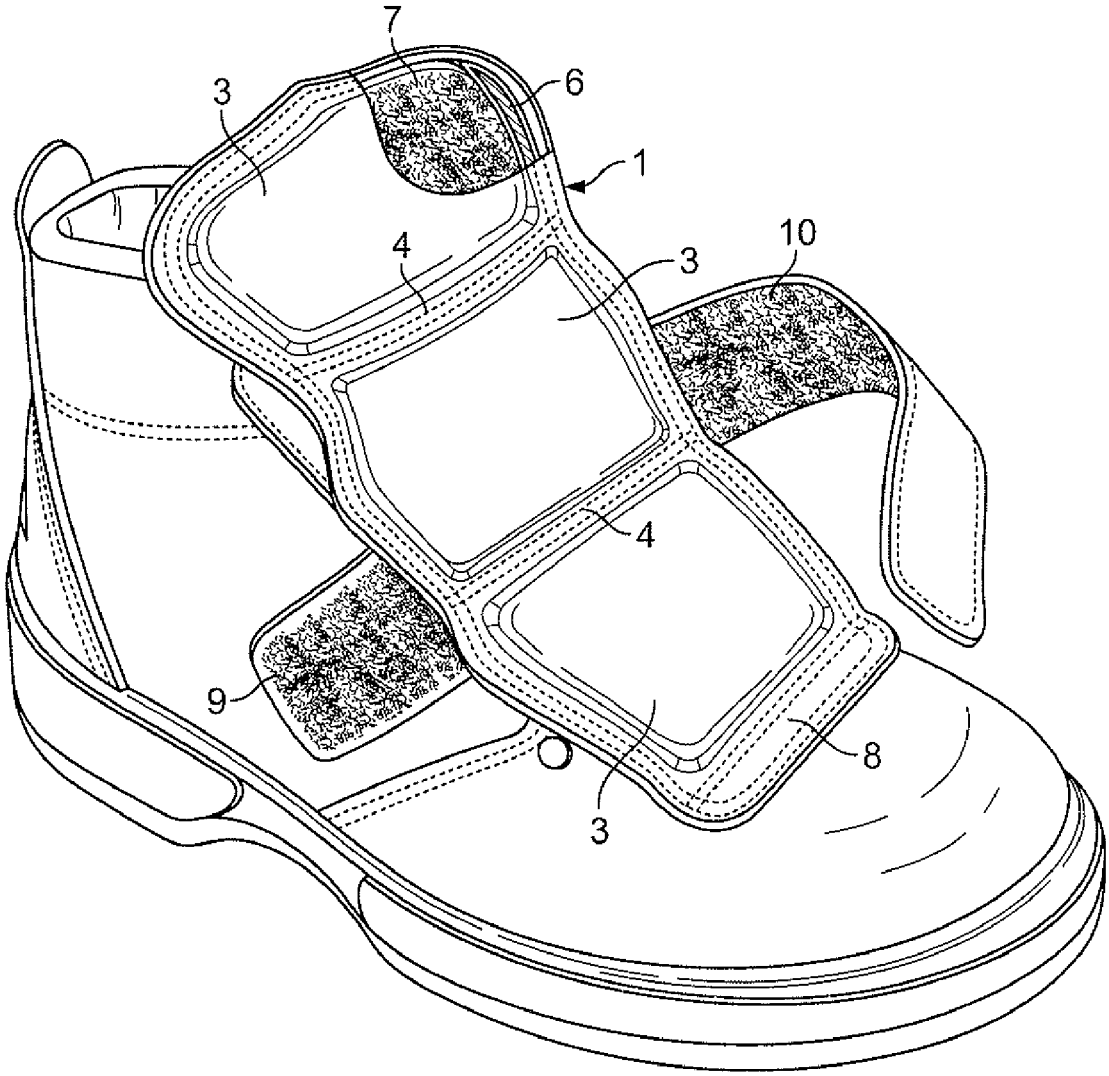
FIG. 1.—It shows a view in perspective of an open boot in which the metatarsal protection is appreciated with a section in which one can observe the resistant sheet and the padded material inside one of the sectors.
Figure 2:
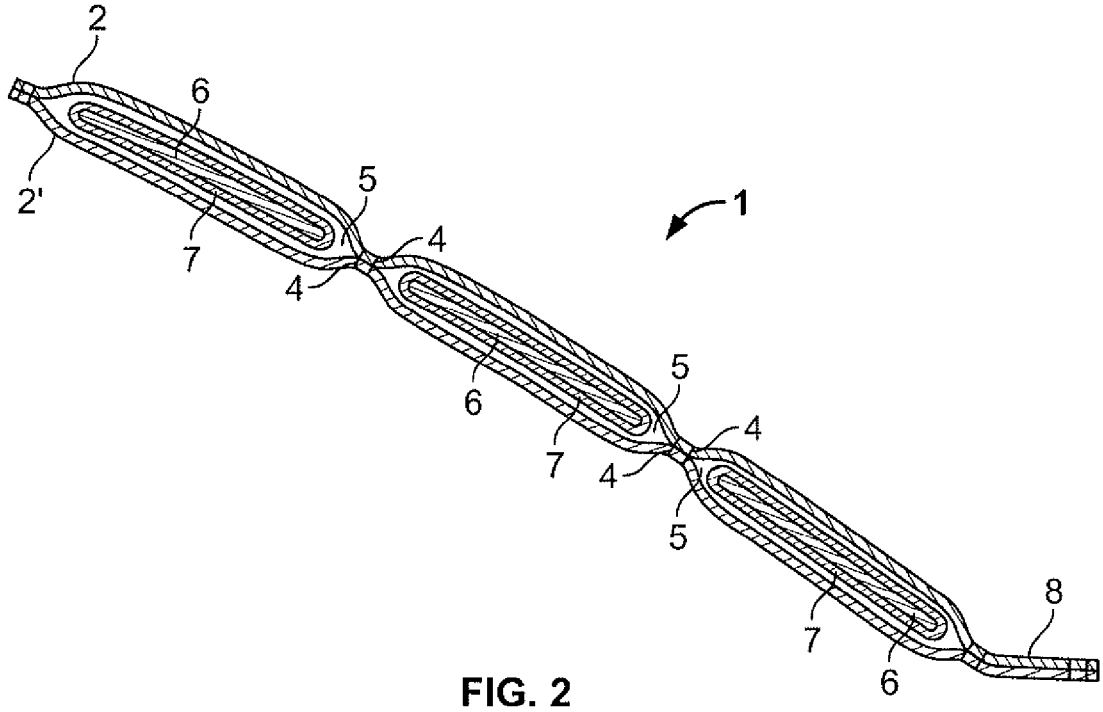
FIG. 2.—It shows a side view of a longitudinal section of the protection.
Figure 3:
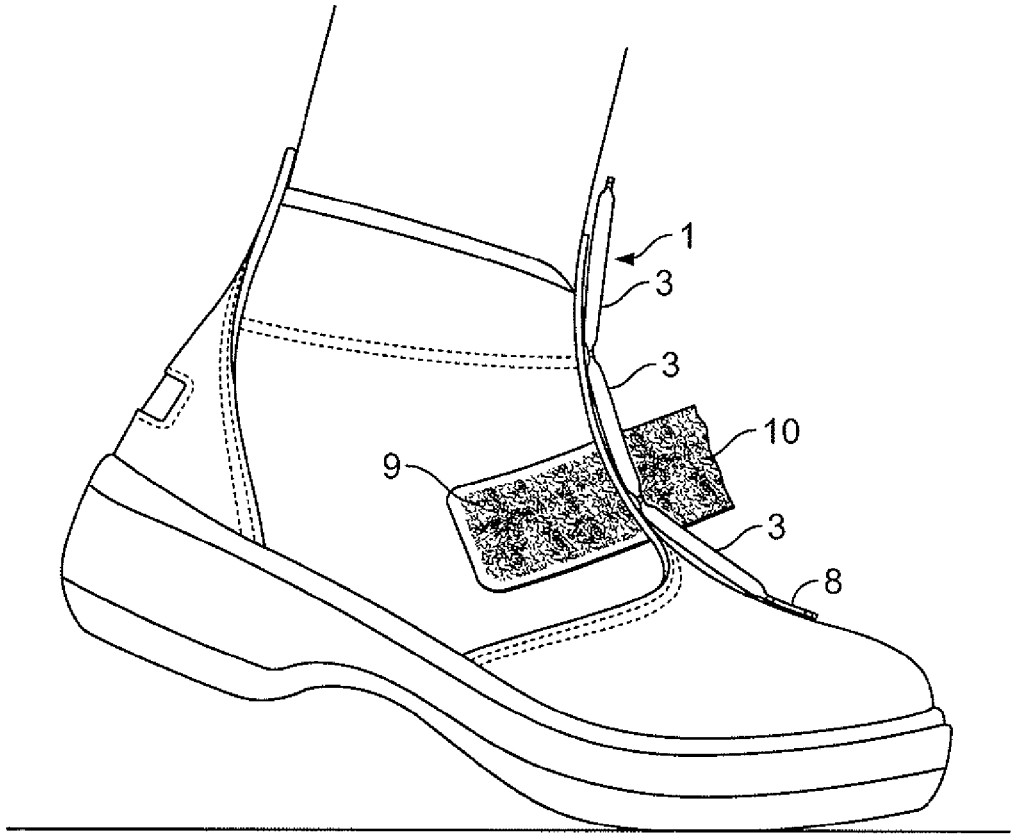
FIG. 3.—It shows a side view of the flexed boot in which one can observe how the protection articulates to adapt to the form of the boot.

Taking the figures represented as reference a preferred mode of embodiment is described of the metatarsal protection for safety footwear which constitutes the object of this invention.

The metatarsal protection is constituted on the basis of a tongue (1) which is conveniently attached to the boot, be this by stitching, rivets, a combination of both or any other means.

The tongue (1) is formed by two layers of leather or of appropriate material (2-2') between which are defined a number of sectors (3), delimited by lines of stitching (4) which allow articulation of the boot, in which some receptacles (5) are to be found which hold sheets (6) of impact-resistant and ductile material, to facilitate the adaptation thereof to the form of the boot when worn and closed.

The resistant sheets (6) are clad with padding (7) inside the receptacles (5).

The sectors (3) of the tongue (1) can be extended transversally thereto in a parallel arrangement and separated at a short distance by the transversal lines of stitching (4) which facilitate the relative inclination between sectors (3) and therefore the articulation of the tongue (1) when the boot is flexed.

Furthermore the tongue (1) comes with a flap (8) which constitutes the connecting element with the boot, to which it is conveniently articulated.

As can be appreciated in FIG. 1 the boot can have a hook and loop type fastener, e.g., a VELCRO strip (9) to which adhere the band (10) which can previously enwrap the tongue (1) to establish the closing of the hoot, although as has been indicated above, the form of closing can be by laces, buckles or of any other nature.

As can be appreciated in FIG. 1 the boot can have a hook and loop type fastener, e.g., a VELCRO strip (9) to which adhere the band (10) which can previously enwrap the tongue (1) to establish the closing of the hoot, although as has been indicated above, the form of closing can be by laces, buckles or of any other nature.

The invention claimed is:

1. A metatarsal protector for safety footwear having a form, comprising:

a tongue divided into a plurality of sectors, each sector defining a receptacle;

a plurality of impact-resistant elements, each element in a receptacle, the elements having ductility to facilitate the metatarsal protector adapting to the form of the safety footwear; and a stitching line delimiting the sectors to further facilitate the metatarsal protector adapting to the form of the safety footwear.

2. The metatarsal protector for safety footwear according to claim 1, wherein the impact-resistant elements further include padding.

3. The metatarsal protector for safety footwear according to claim 1, wherein the sectors extend transversally across the tongue and are spaced from one another.

* * * * *